United States Patent [19]

Delbourgo et al.

[11] Patent Number: 4,830,711

[45] Date of Patent: May 16, 1989

[54] INSTALLATION FOR SEPARATING A SOLVENT FROM A MIXTURE OF SOLVENT AND HYDROCARBONS

[75] Inventors: Patricia Delbourgo, Saint Cloud; Michel Coupard, Feucherolles; Jean-Jacques Delorme, Saint L'Honore, all of France

[73] Assignee: Compagnie Francaise d'Etudes et de Construction "Technip", France

[21] Appl. No.: 58,158

[22] Filed: Jun. 4, 1987

[30] Foreign Application Priority Data

Jun. 5, 1986 [FR] France ..... 86 08132

[51] Int. Cl.[4] ..... B01D 3/06; C10G 21/28

[52] U.S. Cl. ..... 202/173; 202/177; 202/186; 196/98; 196/106; 196/120; 196/134; 203/24; 203/25; 203/73; 203/88; 203/DIG. 2; 203/DIG. 4; 208/321; 208/361; 208/365

[58] Field of Search ..... 203/22-26, 203/71, 73, 88, 100, 99, DIG. 4, DIG. 8, DIG. 16, DIG. 2; 202/174, 173, 177, 235, 180, 186; 196/134, 98, 120, 106, 14.5, 14.52; 208/365, 321, 361, 332, 322, 323; 159/DIG. 32, 17.1

[56] References Cited

U.S. PATENT DOCUMENTS

| | | | |
|---|---|---|---|
| 2,276,089 | 3/1942 | Ragatz | 203/1 |
| 3,514,375 | 5/1970 | Dambrine | 203/26 |
| 3,597,328 | 8/1971 | Michels | 203/24 |
| 3,607,668 | 9/1971 | Williamson | 203/24 |
| 4,177,137 | 12/1979 | Kruse | 208/321 |
| 4,181,577 | 1/1980 | Foley | 203/DIG. 4 |
| 4,214,975 | 7/1980 | Davis et al. | 208/321 |
| 4,390,418 | 6/1983 | Sherman | 208/321 |
| 4,585,524 | 4/1986 | Hoiss | 203/24 |

FOREIGN PATENT DOCUMENTS 2084034 4/1982 United Kingdom .

*Primary Examiner*—Wilbur Bascomb
*Attorney, Agent, or Firm*—Steinberg & Raskin

[57] ABSTRACT

A method of and system for recovering a solvent from a mixture of solvent and hydrocarbons, the system comprising at least two evaporation flasks successively fed with a charge consisting of said mixture to be separated, at least one steam generator performing the condensation of the solvent, a circuit for conveying the evaporated solvent and connecting the flasks to the generator and a circuit of an intermediate fluid in gaseous phase including a compressor for raising the condensation temperature of this fluid, the latter circuit connecting the generator to heat exchangers arranged upstream of each flask.

3 Claims, 1 Drawing Sheet

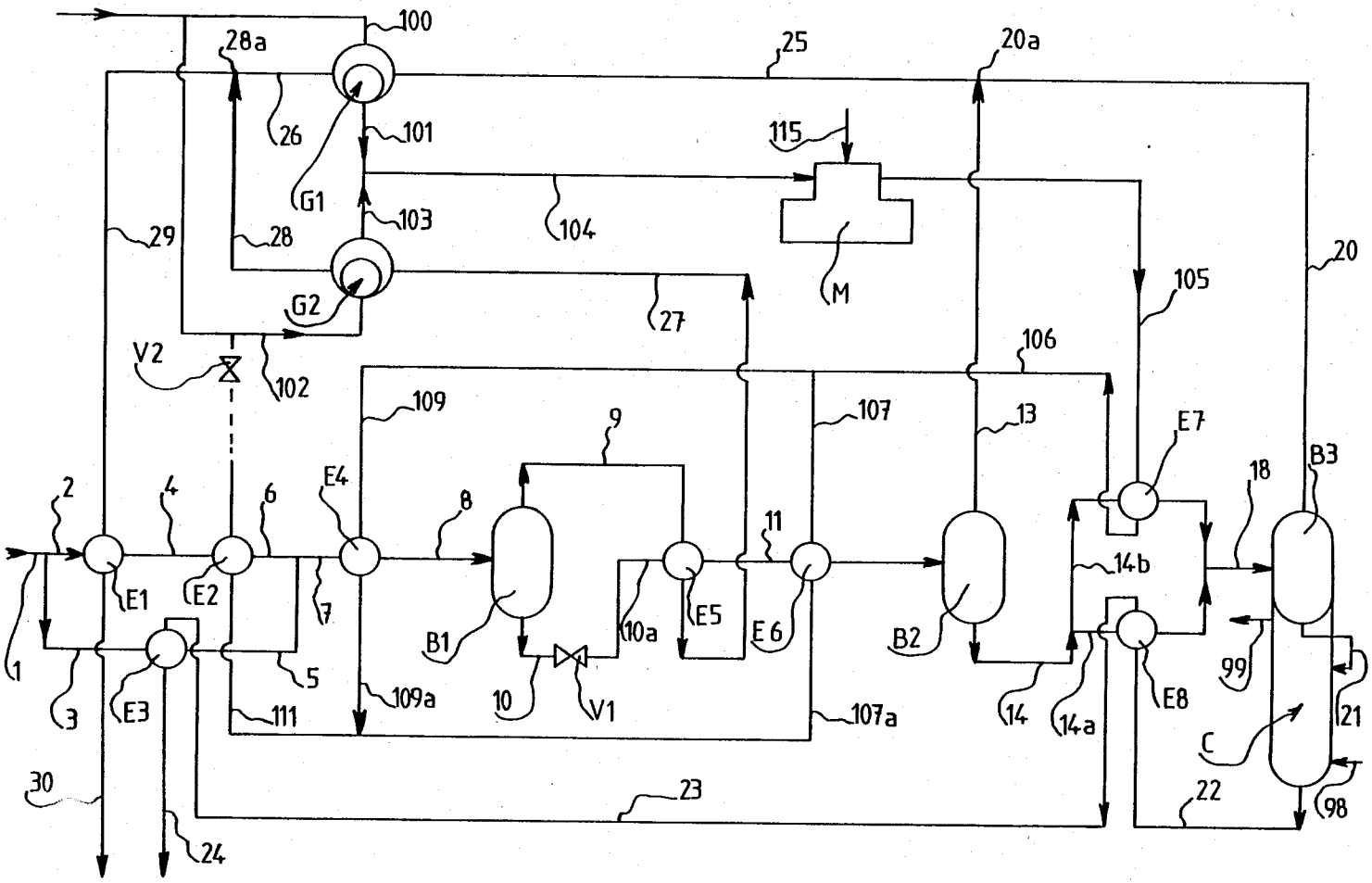
20
B3
21
98
18
99
C
22
105
E7
E8
14b
14a
20a
106
13
14
B2
107
107a
M
115
25
11
E6
E5
27
23
10a
9
V1
104
10
B1
8
100
101
103
109
109a
E4
7
5
G1
G2
26
28
102
6
111
28a
E2
24
V2
4
E1
E3
29
2
3
30
1

INSTALLATION FOR SEPARATING A SOLVENT FROM A MIXTURE OF SOLVENT AND HYDROCARBONS

BACKGROUND OF THE INVENTION

The present invention relates essentially to a method of extracting a solvent from a mixture of solvent and hydrocarbons without any outer heat supply.

It is also directed to a system or plant for carrying out or practicing the method.

A number of methods of and systems for liquid-liquid extraction with a solvent are already known which use solvents for separating families, groups or series of hydrocarbons. These methods and plants however are very much adversely affected by the power costs since it is necessary to subsequently separate the solvent from the extract and raffinate phases.

This ultimate separation always requires a heat supply from the outside to the process or the plant, that supply taking place at a high heat level thereby substantially increasing the costs as is well understandable.

There are thus known methods directed to collecting both extract-solvent and raffinate-solvent phases and heating them in a furnace or by an outer fluid to provide for the evaporation of the solvent and to bring the hydrocarbons to an adequate temperature in order to obtain a viscosity low enough to allow the elimination through stripping of the last traces of solvent.

There are also known more performing methods which carry out successive evaporations in an order of increasing pressures. With such methods, the solvent is flash-evaporated and used to heat the feed of the foregoing flash-evaporation so that it is possible to reduce by about 30% the heat supply from the outside.

These methods however exhibit a number of inconveniences.

They require the use of a source of outer heat (furnace or hot oil) which is at a very high temperature and their operation or working is very unstable since the least disturbance in the temperature or the output of the hot source would be reflected on the plant and put same severely out of order. Moreover, these known methods and plants are of a complicated practice and use and require stacks of heat exchangers and of columns requiring cumbersome or bulky and expensive structures lending themselves badly to the reconstruction of old plants.

SUMMARY OF THE INVENTION

The object of the present invention is to cope in particular with the above-mentioned drawbacks by providing a method of and a system for recovering the solvent from solvent-hydrocarbons mixtures which are particularly simple, reliable or dependable and cheap in that they do not require any heat supply from the outside.

For that purpose, the invention relates to a method of separating a solvent from a mixture of a solvent and hydrocarbons wherein in particular, an evaporation by stages of the solvent is carried out for separating it from the hydrocarbons, characterized in that the staged evaporation of the solvent is performed in a substantially isothermal manner by following an order of decreasing pressures and a heat exchanger is effected between the evaporated solvent and at least one intermediate fluid to obtain the condensation of the solvent and to recover its condensation heat in order that the intermediate fluid in gaseous phase may, after a suitable treatment, reheat the mixture and itself carry out the evaporation of the solvent without any heat supply from the outside being necessary to perform this operation.

It should be pointed out that the treatment of the aforesaid intermediate fluid in gaseous phase involves comprising this fluid to raise its temperature so as to allow the vaporization of the solvent.

In other words, the isothermal evaporation process of the solvent is coupled with a heat pump which recovers the condensation heat from the solvent and raises it to a thermal level high enough so that it may be used for the vaporization proper of the solvent. Moreover, the isothermal evaporation offers advantages of savings in high level energy thereby allowing covering of the needs in heat of this type by the heat due to the irreversibility of the compression in the heat pump.

According to another characterizing feature of the method of the invention, the intermediate fluid recovering the condensation heat from the solvent is water.

It should be further specified that during the staged evaporation of the solvent, the temperature preferably lies between 100° C. and 200° C.

The invention is also directed to a plant for carrying out the above-mentioned method and of the type comprising at least two evaporation flasks or the like successively fed with a charge consisting of a mixture of solvent and hydrocarbons to be separated, characterized by a least one steam generator providing for the condensation of the solvent, by at least one circuit for conveying the evaporated solvent and connecting the flasks to said generator and by at least one circuit of intermediate fluid in gaseous phase comprising means for raising the condensation temperature of this fluid and connecting said generator to at least one heat exchanger arranged upstream of each flask.

It should be specified here that the means for raising the condensation temperature of the intermediate fluid in gaseous phase consists of at least one compressor.

According to an exemplary embodiment, a plant according to the invention comprises three successive flasks for the evaporation of the solvent and is characterized in that the fluxes of vaporized solvent leaving the second and third flasks are brought together before reaching a first steam generator whereas the flux of vaporized solvent leaving the first flask is led to a second steam generator, the fluxes of condensed solvent which leave both aforesaid generators being brought together.

According to still another characterizing feature of this plant, the flux of intermediate fluid in gaseous phase produced by both aforesaid generators feeds a heat exchanger upstream of the third flask and then divides to flow through both heat exchangers upstream of the first and second flasks respectively, and again forms a single flux flowing through a heat exchanger for reheating the charge introduced into the plant.

It should be added here that the aforesaid single flux is connected to the steam generators.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawing given by way of non-limiting example only, illustrating a presently preferred specific embodiment of the invention and wherein the single FIGURE diagrammatically shows a solvent recovering system according to the principles of the invention.

DESCRIPTION OF THE PREFERRED EMBODIMENTS

The system shown on the single FIGURE is for instance the section for recovering the solvent in dewaxed oil of a unit for dewaxing lubricants.

The solvent used may be a (50%-50% by volume) mixture of methylethyl ketone and toluene.

The charge or batch consisting of a solvent-oil mixture is fed to the plant for instance at an absolute pressure of 500 kPa and at a temperature of 39° C. through a pipe line to form the flow or flux 1. The charge or batch is divided into two fluxes designated by reference numerals 2 and 3, respectively and it is preheated in a heat exchange train comprising the heat exchangers $E_1$, $E_2$ and $E_3$ arranged in parallel relationship and then the heat exchanger $E_4$.

In the heat exchanger $E_1$, the charge or batch is reheated by the total flux of condensed solvent 29 and reaches the heat exchanger $E_2$ through the pipe line 4.

In this heat exchanger $E_2$, the flux 4 is reheated. by a steam flux 111 to constitute the flux 6.

In the heat exchanger $E_3$, the flux 3 is reheated by dewaxed oil 23 conveyed to storage facilities by the duct 24 and the flux 3 becomes the flux 5 which is brought together with the flux 6 to thereby form a single flux 7 reaching the heat exchanger $E_4$.

In this heat exchanger $E_4$, the flux 7 is reheated up to the conditions prevailing in the evaporator flask or flash-evaporator $B_1$ by means of condensed steam 109. The evaporator flask $B_1$ operates at a temperature of 148.5° C. and under an absolute pressure of 400 kPa and allows to vaporize about 40% of the solvent contained in the charge or batch passing through the duct 8.

The flux of vaporized solvent leaves the flask $B_1$ through the pipe line 9 whereas the liquid leaving this flask through the pipe line 10 is expanded in a valve $V_1$ down to the pressure of a second evaporator flask $B_2$ which operates under a pressure of 243 kPa, i.e. lower than the pressure of the flask $B_1$ and at a temperature of 150° C., i.e. substantially like that of flask $B_1$. The mixed or combined phase forming the flux **10*a*** after the valve $V_1$ and leading to the evaporator flask $B_2$ is reheated in heat exchangers $E_5$ and $E_6$ up to the aforesaid temperature of the evaporator flask $B_2$.

In the heat exchanger $E_5$, the flux **10*a* is reheated by the flux 9 of vaporized solvent issuing from the flask $B_1$ and this reheated flux 10*a* forms the flux 11 which is in turn reheated by the heat exchanger $E_6$ owing to the condensed steam flowing through the duct 107**.

The flash-evaporation in the evaporator flask $B_2$ occurs as previously stated at a lower pressure than that of the flash-evaporation in the flask $B_1$ thereby allowing to practically remove all the remaining solvent which issues from the flask $B_2$ through the duct 13.

The liquid leaving the flask $B_2$ is pumped from the bottom of this flask and flows through the duct 14 and is reheated by two heat exchangers $E_7$ and $E_8$ arranged in parallel relationship up to a temperature of about 200° C. which is the adequate temperature for carrying out the stripping of the hydrocarbons in a column C.

More specifically, in the heat exchanger $E_8$ the diverted flux **14*a* is reheated by dewaxed oil issuing from the column C through the duct 22. In the heat exchanger $E_7$, the diverted flux 14*b* is reheated by the steam flowing through a duct 105** and generated by a steam compressor M.

Upon leaving the heat exchangers $E_7$ and $E_8$, both diverted fluxes **14*a* and 14*b*, which are at different temperatures, are blended again to form a flux 18** which feeds a flask $B_3$.

This flask operates at a temperature of 200° C. and under an absolute pressure of 243 kPa like that of the flask $B_2$.

The liquid fraction 21 issuing from the flask $B_3$ is then stripped in the column C by the steam 98 so as to remove the last traces of solvent in the flux 99.

The dewaxed oil 22 leaving the column C is, as previously explained, carried to the storage facilities by the pipe line 24 after having been cooled in the heat exchangers $E_8$ and $E_3$.

The vaporized solvent leaves the flask $B_3$ through the duct 20 and this flux of vaporized solvent is mixed at **20*a* with the flux of solvent 13 issuing from the flask $B_2$ to form the flux of solvent 25 (at an absolute pressure of 243 kPa and at a temperature of 154° C.). The vapours of the flux 25 are fully condensed and then subcooled after passing into a first heat exchanger or steam generator $G_1$ performing the condensation of the solvent and which is fed with liquid water through a pipe line 100. The flux of solvent thus condensed forms the flux 26**.

The flux of vaporized solvent 9 leaving the first evaporator flask $B_1$ is partially condensed in the heat exchanger $E_5$ and is led through the duct 27 to a second heat exchanger or steam generator $G_2$ which provides for the full condensation and subcooling of the solvent vapours. The condensed solvent forms the flux 28 under the same temperature conditions as the flux 26. The flux 28 is then expanded in a valve (not shown) and then mixed with the flux 26 as seen at **28*a* to form the previously mentioned flux 29 which is cooled in the heat exchanger $E_1$ and then carried to the storage facilities through a pipe line 30**.

Now, the heat pump system will be described which consists of both steam generators $G_1$, $G_2$ fed with liquid water through the pipe lines 100 and 102, respectively, of the compressor M and of the heat exchangers $E_2$, $E_4$, $E_6$ and $E_7$.

The saturated steam produced by both steam generators $G_1$ and $G_2$ and resulting from the recovery of the condensation heat of the solvent fluxes 25 and 26 passes into the ducts 101 and 103 which are joined together to form a flux 104 of saturated steam which is compressed by the compressor M. The latter comprises for instance two compression stages and the steam is desuperheated between both stages by water as shown by the arrow 15.

At the outlet of the compressor M, the steam is at a temperature of about 220° C. and at an absolute pressure of about 580 kPa and this steam flowing through the duct 105 is used to supply high level heat to the heat exchanger $E_7$ upstream of the third flask $B_3$. Upon leaving this heat exchanger, the steam flows in a duct 106 and divides to form both ducts 107 and 109 extending through the heat exchangers $E_6$ and $E_4$ respectively, to heat the supplies of the flasks $B_2$ and $B_1$ respectively. The steam condensates flowing then through the ducts **107*a* and 109*a* are blended to form the flux 111 and are subcooled down to 117° C. and then expanded in a valve $V_2$ down to the absolute pressure of 180 kPa for eventually flowing back to the steam generators $G_1$ and $G_2$ through the pipe lines 100 and 102**.

Reference should now be had to the following table showing the advantages of the system which has just been described with respect to known systems which use a heat supply from the outside to perform the evaporation of the solvent whereas the plant according to the invention does not use it.

TABLE

Selected example: Dewaxed oil section of a solvent-dewaxing unit (capacity: 120,000 t/year of oils)

| Utilities | Systems: Known systems (3 or 4 evaporator flasks) | Systems: System of the invention (3 evaporator flasks with heat pump) |
|---|---|---|
| Utilities consumption | | |
| Fuel (kg/t of solvent in the charge) | 7.6 | 0 |
| Electricity (kW/t of solvent in the charge) | 1.8 | 12.9 |
| Stripping steam (kg/t of solvent in the charge) | 7.9 | 7.9 |
| Primary energy | | |
| Total (kcal/kg of solvent in the charge) | 84 | 33.5 |

It appears straightforwardly from this table that the gain in primary energy represents about 60% with respect to the known systems.

It has therefore been provided, according to the invention, a method of and a system for solvent recovery which exhibit a much higher power yield or efficiency and which do not require any heat supply from the outside, which heat supply is used in particular to compensate for the irreversibilities and losses of the system. Now, in the diagram according to the invention, the irreversibilities are minimized and the thermal degradation is reduced. In other words, the heat between the process fluids and the fluid of the heat pump is transferred with a minimal temperature degradation thereby enabling the system to work under optimum power conditions.

It should be also pointed out that the solvent is not heated up to high temperatures upon the evaporation and would therefore undergo a lesser thermal degradation.

It should further be noted that the plant of the invention exhibits an outstanding operating stability owing to the recovered heat being mixed at the heat pump and redistributed in parallel relationship between the points of evaporation of the solvent, thereby allowing to separately adjust the heat to be supplied to each flash evaporating step.

As previously explained, the evaporation of the solvent in the flasks $B_1$ and $B_2$ is performed in an order of decreasing pressures so as to allow the evaporation of a very substantial amount of solvent while remaining at a substantially constant temperature which may for instance lie between 100° C. and 200° C. This still allows to minimize the irreversibilities and to have a call or demand for concentrated heat within a very narrow range of temperatures, thereby being perfectly suitable for the use of a heat pump.

The invention at last provides a method of and a system for solvent recovery which exhibit outstanding results owing to the use of an isothermal evaporation scheme of the solvent coupled with a heat pump recovering the condensation heat of the solvent and raising it to a thermal level high enough to enable the same to be used to provide for the vaporization proper of the solvent.

It should be understood that the invention is not at all limited to the embodiment described and shown which has been given by way of example only.

Thus, the method according to the invention may quite well be incorporated into old solvent recovery systems.

This means that it comprises all the technical equivalents of the means described as well as their combinations if same are carried out according to its gist.

What is claimed is:

1. An installation for separating a solvent from a mixture of solvent and hydrocarbons, comprising:

a first circuit (1-8, 10, 11, 14, 18) for conveying a mixture of solvent and hydrocarbons to the installation;

first, second and third evaporation flasks ($B_1$, $B_2$, $B_3$) connected to said circuit and successively fed with the mixture;

a first steam generator ($G_1$) connected to said second and third evaporator flasks ($B_2$, $B_3$) through ducts (13, 20, 25) for bringing together and conveying vaporized solvent from said second and third flasks ($B_2$, $B_3$) to said first generator ($G_1$);

a second steam generator ($G_2$) connected to said first evaporation flask ($B_1$) through one duct (27) for conveying vaporized solvent from said first flask ($B_1$) to said second steam generator ($G_2$);

conduits (26, 28, 29) connected to the first and second steam generators ($G_1$, $G_2$) respectively and brought together for collecting condensed solvent leaving both steam generators ($G_1$, $G_2$);

a second circuit (100, 102) for supplying both steam generators ($G_1$, $G_2$) with liquid water respectively, the liquid water being vaporized by the vaporized solvent passing through said steam generators ($G_1$, $G_2$) which is condensed therein;

at least one heat exchanger ($E_4$, $E_6$, $E_7$) provided on said first circuit and arranged upstream of at least one of said first, second and third evaporation flasks ($B_1$, $B_2$, $B_3$); and a third circuit (101, 103, 104, 105, 106, 107, 109) for conveying the vaporized water, comprising at least one compressor (M) for raising the condensation temperature of this vaporized water and connecting both steam generators (G1, G2) to said heat exchangers ($E_4$, $E_6$, $E_7$), whereby the vaporized water performs the reheating of the mixture and the evaporation of the solvent in the flasks without any heat supply from the outside for effecting that evaporation being necessary.

2. An installation according to claim 1, wherein further comprises:

three heat exchangers ($E_4$, $E_6$, $E_7$), provided upstream of said first, second, and third flasks ($B_1$, B2, B3) respectively;

an additional heat exchanger ($E_2$) provided on said first circuit and arranged upstream of said heat exchanger ($E_4$) disposed upstream of said first evaporation flask ($B_1$);

said third circuit comprises one duct (105) passing through said heat exchanger ($E_7$) disposed upstream of said third evaporation flask ($B_3$) and being divided into two ducts (107, 109) passing through said heat exchangers, ($E_6$, $E_4$) disposed upstream of said second and first evaporation flasks respectively; and one circuit (111) connecting said two ducts (107, 109) of said third circuit to said additional exchanger ($E_2$) provided on said first circuit and reheating the mixture introduced into the installation.

3. An installation according to claim 2, wherein said one conduit (111) is connected to said steam generators ($G_1$, $G_2$).

* * * * *